United States Patent [19]

Garfinkel

[11] Patent Number: 4,781,648

[45] Date of Patent: Nov. 1, 1988

[54] REVERSIBLE PLUSH TOY

[76] Inventor: Henry Garfinkel, 31 Dogwood Rd., Searingtown, N.Y. 11507

[21] Appl. No.: 21,350

[22] Filed: Mar. 3, 1987

[51] Int. Cl.[4] ..... A63H 3/12; A63H 3/02

[52] U.S. Cl. ..... 446/321; 446/369; 446/390

[58] Field of Search ..... 446/321, 320, 369, 390, 446/371

[56] References Cited

U.S. PATENT DOCUMENTS

| | | | |
|---|---|---|---|
| 2,274,303 | 2/1942 | Ornstein | 446/369 X |
| 2,325,750 | 8/1943 | De Vries | 446/321 |
| 3,851,419 | 12/1973 | Kaelin | 446/321 |

*Primary Examiner*—Mickey Yu

*Attorney, Agent, or Firm*—Dennison, Meserole, Pollack & Scheiner

[57] ABSTRACT

A reversible toy having a pair of substantially equal size fabric skins peripherally secured and configured to selectively expose each skin while enclosing the other skin. Each skin has multiple appendages associated therewith and aligned with the appendages associated with the other skin. The two appendages of each aligned set of appendages are invertible one within the other for an outward projection of an appendage associated with an exposed skin and a corresponding inverting and storing of the aligned appendage within the projecting appendage. The stored appendages defines bulk stuffing for the exposed appendage. The inversion of each appendage is effected automatically upon an extension of the associated appendage.

7 Claims, 2 Drawing Sheets

REVERSIBLE PLUSH TOY

BACKGROUND OF THE INVENTION

Convertible toy figures, that is toy figures which are particularly adapted, through various means, to convert from one configuration to another are known in the art and cover a wide range toys from mechanical robots which convert into vehicles to soft doll or animal figures which convert between differing configurations.

The present invention is particularly concerned with convertible soft toys of the type generally suggested in the following patents:

U.S. Pat. No. 4,336,655, Moreau, June 29, 1982
U.S. Pat. No. 4,413,422, McSweeney, Nov. 8, 1983
U.S. Pat. No. 4,563,159, Hill et al, Jan. 7, 1986
U.S. Pat. No. 4,614,505, Schneider et al, Sept. 30, 1986

The McSweeney and Schneider et al patents illustrate transformable toys wherein an animal configuration, including projecting wings, legs and other appendages, converts or transforms into a egg-shaped or ball configuration with no projecting appendages.

The patent to Moreau provides for a convertible toy wherein a shell cover, carrying appendages, is selectively moved to enclose or expose a pair of oppositely directed animal heads.

The patent to Hills et al provides for a toy and tote bag therefor which selectively accomodate each other.

SUMMARY OF THE INVENTION

The reversible toy of the present invention is basically a plush toy which, in each of the two proposed configurations thereof, incorporates projecting appendages, approximating in appearance, animals, fanciful creatures, and the like.

Of particular significance is the provision of appendages in each formation or configuration of the toy which are specifically unique to that configuration, principally in external appearance and color. In this manner, the two configurations of a reversible toy in accord with the present invention can be distinctly different, for example a brown plush dog and a white plush cat, with substantially the only similarity, other than for size, being the presence of four appendages corresponding to the four legs of each animal.

Also of particular significance is the interrelationship of the two sets of appendages whereby each appendage has a corresponding appendage in the other configuration secured thereto in a manner whereby the extension of one appendage will automatically retract the other appendage therewithin to provide stuffing or internal support therefor. As such, the appendages themselves, as is case with the body of the toy, are completely reversible into a basically like configurations with the components of the stored configuration being concealed within the exposed configuration and providing the internal support or stuffing therefor.

Basically, the reversible plush toy of the invention includes two fabric body "skins" or sheets sewn back to back about the peripheral edges thereof to present a pair of opposed differing configurations. Duplicate appendages, insofar as a general size and shape, are provided in back-to-back pairs on the skins. Each appendage includes a projecting hollow sleeve proximal to the corresponding body skin, and a distal stuffed portion, normally constituting the paw, foot or the like for the appendage. The sleeves, at the outer ends thereof adjacent the distal ends of the appendages, are secured together as by sewing, whereby the extension of one appendage will automatically result in an inward drawing of the companion appendage into the hollow sleeve portion of the first or extended appendage, thereby providing stuffing or internal support therefor. A pulling on the stored appendage will result in an inverting of the companion appendage and a reversing of the positions thereof.

The body skins or sheets themselves are selectively folded to outwardly expose the outer surface of one skin while enclosing the second skin therein. In conjunction therewith, appropriate closure means, such as a reversible zipper, is provided for selectively closing each of the body skins. The stored body skin will, in each instance, provide internal support or stuffing for the plush toy. While it is possible that additional stuffing may be provided between the skins within the peripherally secured edges thereof, this is normally not necessary other than for possibly in the head area wherein additional stuffing would be desired to maintain the specific facial characteristics of the defined heads.

Additional features, objects and advantages of the invention will become apparent from the more detailed Description of the Invention folowing hereinafter.

DESCRIPTION OF PREFERRED EMBODIMENT

Figure 1:
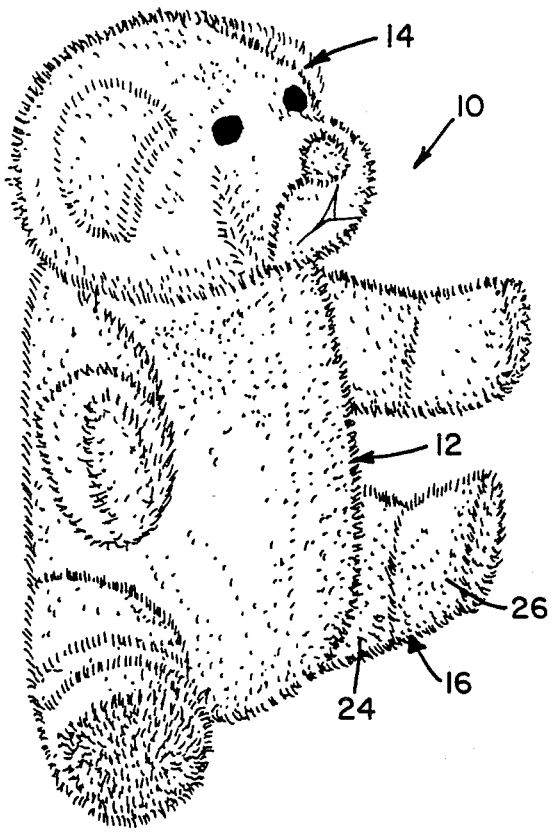
FIG. 1 is a front perspective view of the toy of the invention presenting one configuration.

Referring now more specifically to the drawings, the reversible plush toy 10 has been illustrated as, in one configuration thereof, having the appearance of a toy dog comprising basically a body 12, a head 14, and four appendages 16 in the nature of legs. The toy 10, upon being reversed or inverted, noting sequentially FIGS. 2, 3 and 4, will present a configuration which, while incorporating the same basic components including a body 12, head 14 and appendages 16, will, normally, be of a distinctly different appearance. Such a different appearance, a cat in the illustrated example, can be based on a number of factors including color, facial expression, animal type, and the like. The actual inverting of the toy from one configuration to the other is effected through a substantially full height opening along a relatively inconspicuous portion of the toy, for example the back. The opening will have an appropriate closure means, normally a reversible zipper 20, associated therewith.

The toy 10 includes two skins or body sheets 22 which, while presenting distinctive and normally different external body surfaces, are substantially identical in shape and size. Each of the body skins 22 includes at least one appendage 16, and preferably multiple appendages such as the four legs of the reversible toy of FIGS. 1 and 4. Each of the appendages 16 includes a hollow sleeve portion 24 proximal to and preferably formed with and projecting from the corresponding body sheet 22.

The distal or outer end portion 26 of each appendage 16, which if the toy is to simulate an animal will normally constitute or incorporate a simulated paw, is secured to the outer end portion of the hollow sleeve 24 and forms a natural-appearing continuation thereof. This distal portion 26 of each appendage 16 is usually preferably stuffed or otherwise shape-sustaining as opposed to the normally collapsible proximal sleeve portion 24. Each of the appendages 16 is basically of the same construction, that is incorporating the hollow inner sleeve portion and the stuffed outer "paw" portion.

Each of the skins will also incorporate a distinctive head 14 with specifically defined facial features which are retained through selective stuffing, stitching, and the like. Depending upon the nature of the facial characteristics, for example an elongate snout or an elephant's trunk, the facial features can actually constitute appendages structurally formed in the manner set forth with regard to the leg-like appendages 16. For manufacturing purposes, the skins will normally be formed of multiple sections or panels sewn or otherwise joined into the desired shape.

The two basically identical body skins or sheets 22, in the constructed toy, are peripherally sewn in back-to-back relation to each other with the corresponding appendages arrange in aligned pairs, one appendage associated with each skin.

With regard to the appendages themself, in the assembled skins, the outer edge areas of the hollow sleeve portions 24 of each aligned pair of appendages 16 are peripherally stitched to each other as indicated at 28. This stitching, as suggested in FIGS. 5, 6 and 7, can simultaneously secure the "paws" or distal end portions. Secured in this manner, it will be appreciated that as one appendage 16 is extended, the aligned companion appendage is inwardly drawn into the proximal hollow sleeve portion 24 of the first appendage with the corresponding hollow sleeve portion 24 of the aligned appendage inverting and, with the stuffed distal portion of the second or aligned appendage, filling or stuffing the hollow sleeve portion of the first appendage, thereby providing internal bulk and support therefor. It is preferred that the stuffed distal end portions either be approximately equal in size to the corresponding hollow sleeve portions, or sufficiently compressible, as suggested in FIGS. 5, 6 and 7, for a "stuffed" reception therein.

Figure 2:
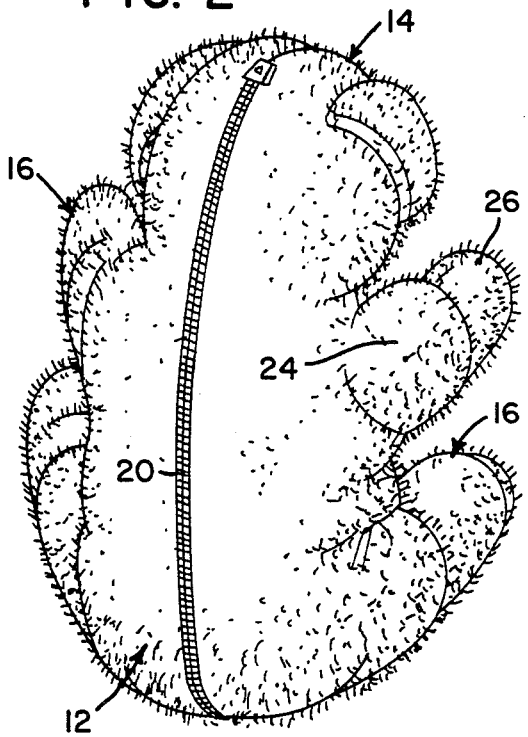
FIG. 2 is a rear perspective view thereof.
Figure 3:
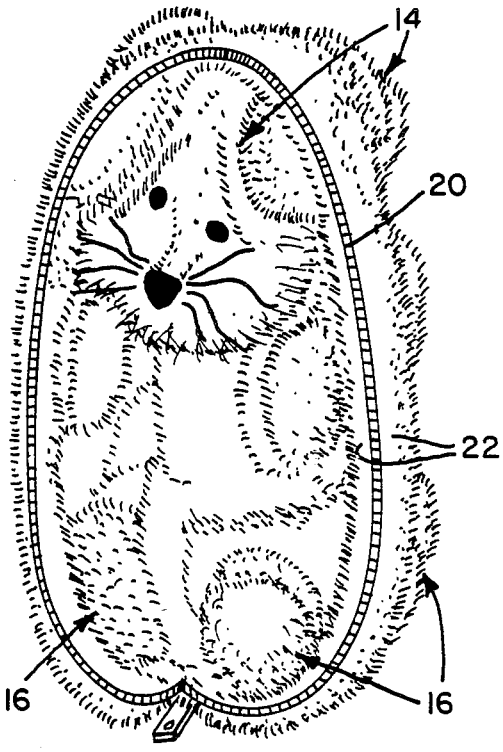
FIG. 3 is a perspective view illustrating the body opened for reversing.
Figure 4:
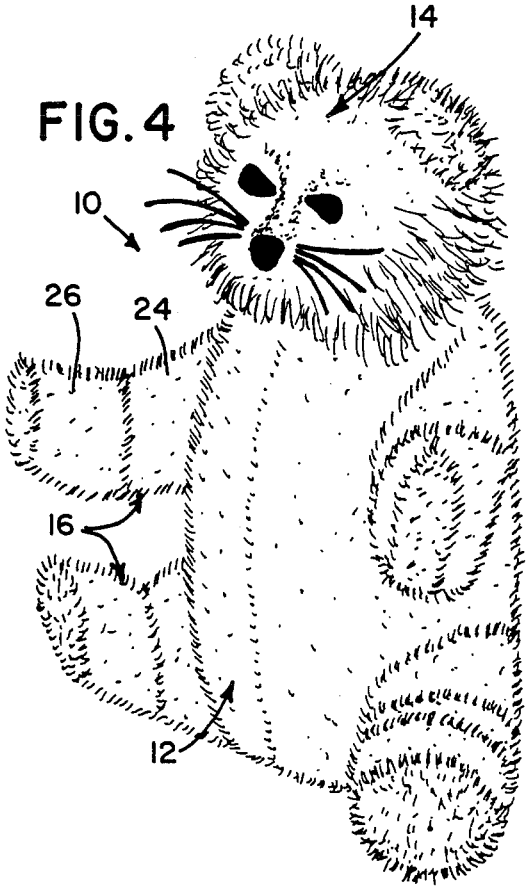
FIG. 4 is a front perspective view of the toy completely reversed.

The manner of reversing the skins 22, along with the heads 14, to achieve the transformation between one animal and the other is relatively straightforward and will be readily appreciated from FIGS. 2, 3 and 4. It will be recognized that upon a reversing of the skins and heads, the outer skin and head will receive and store the inner skin and head which in turn provides for the plush stuffed bulk for the exposed skin and distinctive body surface.

In addition to the basic transforming or reversing of the bodies from one configuration to another, the uniquely configured paired appendages are also converted through an inversion thereof. This is basically accomplished by a selective outward pulling on the distal end portion of the "to be" exposed appendage 16 with the companion or paired appendage, which is to be stored or enclosed, inverting and retracting into the pulled appendage to provide internal stuffing and stabilizing bulk therefor.

Figure 5:
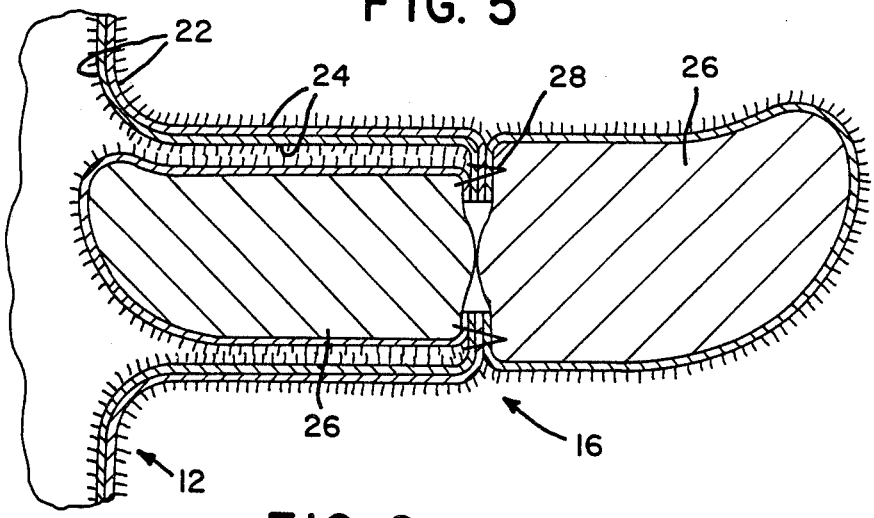
FIGS. 5, 6 and 7 are cross-sectional details illustrating the sequence in reversing an appendage.
Figure 6:
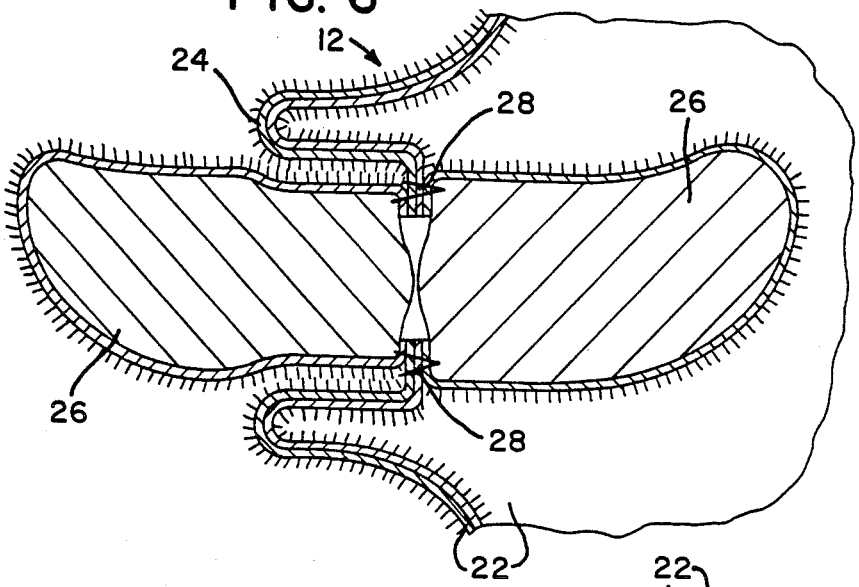
Figure 7:
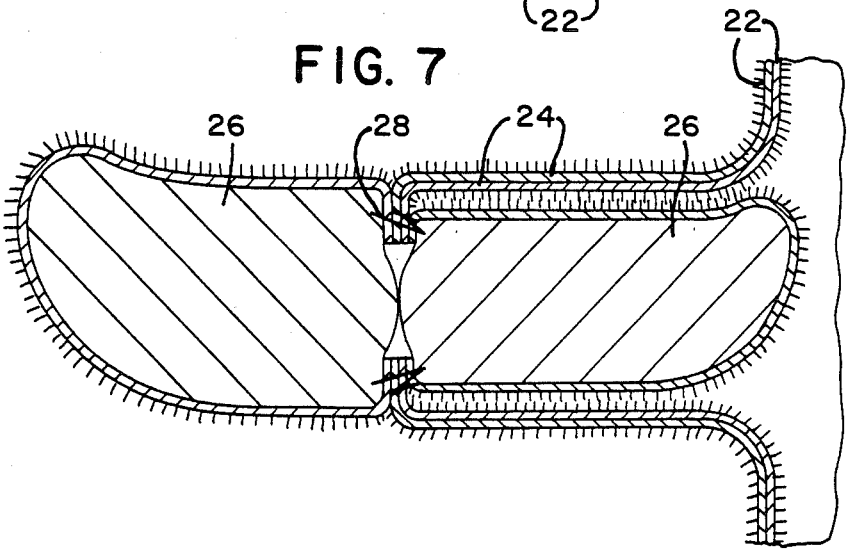

Noting FIG. 3, as the inner skin is exposed, the associated appendages are grasped and pulled outward to complete the reversal. This procedure will be appreciated from FIGS. 5, 6 and 7. FIGS. 5 and 7 illustrate the two extreme positions of a paired set of appendages 16, for example the lower right-hand legs of the "dog" of FIG. 1 and the "cat" of FIG. 4. FIG. 6 illustrates a paired set of appendages partially reversed generally in accord with the lower right-hand leg in FIG. 3. This inverting of the appendages, while a simple procedure easily accomplished in conjunction with a reversing of the skins, is both structurally and conceptually unique.

The accomodation of each of the stored or enclosed appendages 16 within the aligned exposed appendage not only stabilizes the exposed appendage but also avoids the presence of any possible distortion of the basic body configuration such as might arise were it necessary to store extending appendages internally within the body itself.

The actual sheet or skin material, including the material of the appendage portions and head, will be preferably of a soft flexible fabric, normally with a plush pile, providing the appearance, in both configurations of the toy, of a conventional plush stuffed animal or the like.

The foregoing is considered illustrative of the principals of the invention. The surface characteristics of the reversible configurations can vary. However, the configuration defining skins will be of approximately equal size and incorporate, to a major degree, align appendages, normally in multiple sets providing, as an example, four legs on each configuration. The two paired aligned appendages of each set are invertable relative to each other to selectively provide a stuffed projecting appendage in association with each configuration upon an exposure of the configuration. While the appendages have been described basically as animal legs, other appendages are also contemplated, for example, arms, elephant trunks, animal horns, animal ears, and the like.

I claim:

1. A reversible toy comprising a body with opposed first and second body surfaces each selectively exposable to constitute an outer body surface which both defines an outer body appearance and encloses the other body surface, means defining a closeable opening through said body and the opposed surfaces thereof for a reversing of the toy by passing the bulk of the body through the opening to selectively interchange the outer body surface and the stored body surface, at least one projecting appendage secured to each of the opposed body surfaces in substantial alignment with a paired appendage on the opposed body surface, the paired appendages being selectively extensible and retractable, one relative to the other, to define an exposed appendage projecting from the outer body surface and a stored enclosed appendage enclosed with the stored body surface, and means for automatically effecting inversion of said at least one projecting appendage upon extension of said paired appendage.

2. A reversible toy comprising a body with opposed first and second body surfaces each selectively exposable to constitute an outer body surface which both defines an outer body appearance and encloses the other body surface, means defining a closeable opening through said body and the opposed surfaces thereof for a reversing of the toy by passing the bulk of the body through the opening to selectively interchange the outer body surface and the stored body surface, at least one projecting appendage secured to each of the opposed body surfaces in substantial alignment with a paired appendage on the opposed body surface, the paired appendages being selectively extensible and retractable, one relative to the other, to define an exposed appendage projecting from the outer body and a stored enclosed appendage enclosed with the stored body surface, wherein the substantially aligned appendages are selectively invertible with the stored appendages received within the exposed appendage and defining at least a partial bulk stuffing for the exposed appendage.

3. The reversible toy of claim 2 wherein each appendage comprises a hollow sleeve portion proximal to the corresponding surface, and a stuffed distal portion beyond the hollow sleeve portion, at least a major extent of the sleeve portion and the stuffed distal portion of a stored appendage being received within the hollow sleeve portion of an aligned exposed appendage.

4. The reversible toy of claim 3 wherein the sleeve portions of the aligned appendages are secured together adjacent the corresponding distal portions thereof for an automatic inversion and storage of a sleeve portion and associated distal portion upon an extension of the opposed aligned appendage.

5. The reversible toy of claim 4 wherein said first and second body surfaces are defined by first and second body skins peripherally secured together in overlying relation to each other.

6. The reversible toy of claim 5 including multiple appendages associated with each skin and provided in aligned selectively invertible pairs incorporating proximal hollow sleeve portions and stuffed distal portions with the appendages of each pair of appendages being selectively invertible one within the other.

7. The reversible toy of claim 6 wherein each skin includes a head with a facial portion thereon, each head being selectively stored within the other head upon an exposure of the other head to define bulk stuffing.

* * * * *